United States Patent [19]

Matsumoto

[11] Patent Number: 4,652,254

[45] Date of Patent: Mar. 24, 1987

[54] CENTRIFUGAL SEPARATOR

[75] Inventor: Takashi Matsumoto, Sakai, Japan

[73] Assignee: Matsumoto Machine Mfg., Co., Ltd., Sakai, Japan

[21] Appl. No.: 720,597

[22] Filed: Apr. 8, 1985

[30] Foreign Application Priority Data

Feb. 1, 1985 [JP] Japan ..... 60-16452

[51] Int. Cl.[4] ..... B04B 11/08

[52] U.S. Cl. ..... 494/58; 210/372; 494/36

[58] Field of Search ..... 494/56, 57, 58, 59, 494/36, 61, 62; 210/372, 369

[56] References Cited

U.S. PATENT DOCUMENTS 1,542,747 6/1925 Verney ..... 494/57
2,894,634 7/1959 Lepoutre ..... 494/58
3,779,450 12/1973 Shapiro ..... 494/57
3,864,256 2/1975 Hultsch ..... 494/58
3,937,397 2/1976 Zitke ..... 494/58

*Primary Examiner*—Robert W. Jenkins
*Attorney, Agent, or Firm*—Pearne, Gordon, McCoy & Granger

[57] ABSTRACT

A centrifugal separator is disclosed which is capable of carrying out the discharge of substantially all solid matter formed by the liquid-removing of stock liquid by suction. The centrifugal separator includes an annular recess provided at the bottom of a rotatable basket to receive solid matter scraped by a scraper and a solid matter discharge pipe having a solid matter intake inserted in the recess of the basket to discharge the solid matter received in the recess therethrough to the exterior of the basket.

18 Claims, 16 Drawing Figures

CENTRIFUGAL SEPARATOR

BACKGROUND OF THE INVENTION

1. Field of the Invention

This invention relates to a centrifugal separator, and more particularly to a centrifugal separator which is adapted to feed stock liquid to a basket to separate the liquid into solid matter component or cake and liquid component.

2. Field of the Invention

Conventionally, a closed-type centrifugal separator has been widely used for the preparation of pharmaceutical material and the like, because it avoids the inclusion of injurious materials such as impurities, bacteria and the like therein.

A centrifugal separator is generally adapted to subject stock material to a liquid-removing or drainage treatment, scrape solid matter component deposited as a layer on the inner periphery of a basket by means of a scraper and discharge the scraped solid matter to the exterior of the basket. The scraper comprises a drive shaft provided to be axially movable in the basket, a scraper blade mounted on the drive shaft and a drive mechanism for rotating the scraper blade about the drive shaft and moving the scraper blade in the axial direction of the basket, and is adapted to be actuated to carry out scraping of the solid matter. For example, the scraper is adapted to carry out the scraping operation in a manner to pivotally move the scraper blade to the periphery of the basket to allow the scraper blade to enter the solid matter layer while rotating the basket at a low speed and concurrently gradually downwardly move the scraper blade along the axial direction of the basket, to thereby scrape the solid matter.

Although an open-type centrifugal separator is adapted to discharge the so-scraped solid matter through an opening provided at the lower portion of the basket, the closed-type centrifugal separator which is not provided with such an opening is required to suck the solid matter collected in the basket into a solid matter discharge pipe connected to a suction pump and discharge the solid matter therethrough to the exterior of the basket.

As one of the closed-type centrifugal separators adapted to discharge the solid matter using such a solid matter discharge pipe, a centrifugal separator is proposed which is constructed in a manner such that the scraper blade is communicated at the distal end thereof with a suction port of the the solid matter discharge pipe to suck and discharge the scraped solid matter upon scraping of the scraper blade. However, the centrifugal separator has a disadvantage that it fails to suck all the scraped solid matter, so that a considerable part of the scraped solid matter falls on the bottom of the basket to deposit thereon. The deposition of the solid matter on the bottom of the basket above a level causes the scraper blade to abut against the deposited solid matter to be prevented from further lowering, resulting in the further scraping operation not being carried out. This causes the solid matter remaining in the basket to be increased to lead to an increase in the solid matter uselessly wasted.

In order to eliminate such a problem, it is considered to insert another solid matter discharge pipe into the basket to discharge the solid matter deposited on the lower portion of the basket by suction. Unfortunately, this causes the structure of the centrifugal separator to be highly complicated. Also, the conventional centrifugal separator is generally constructed in a manner such that the overall bottom of the basket is of flat form; accordingly, it is still less likely to discharge all the solid matter deposited on the bottom of the basket in spite of use of the further discharge pipe. Thus, the problem that a considerable amount of the solid matter remains in the basket is still not solved.

Accordingly. it is highly desirable to develop a centrifugal separator which is capable of efficiently carrying out the discharge of substantially all scraped solid matter with a simple structure.

SUMMARY OF THE INVENTION

The present invention has been made in view of the foregoing disadvantage of the prior art.

Generally speaking, in accordance with the present invention, a centrifugal separator is provided which comprises a basket, a scraper for scraping solid matter formed in the basket, an annular recess provided at the bottom of the basket to receive the scraped solid matter therein, and a solid matter discharge pipe having a solid matter intake inserted in the recess of the basket and serving to discharge the solid matter received in said recess to the exterior of the basket.

After the drainage or liquid-removing treatment of stock liquid, the basket is rotated at a low speed and the solid matter or cake formed on the inner periphery of the basket is scraped by the scraper. This causes the scraped solid matter to be dropped in the recess provided at the bottom of the basket and deposited in the form of powders in the recess, which is then discharged through the solid matter discharge pipe to the exterior of the basket by suction. Thus, since the solid matter is collected in the recess of the basket and fed through the solid matter discharge pipe to the exterior of the basket by suction, substantially all the solid matter can be discharged. When the powdered solid matter collected in the recess is removed by suction, additional solid matter is dropped in the recess in amounts corresponding to the removed or discharged solid matter. This prevents solid matter from being deposited in large amounts below a scraper blade of the scraper, to thereby ensure the smooth downward movement of the scraper blade. Accordingly, the scraping operation is smoothly carried out without any interruption to continuously discharge the solid matter or cake.

In accordance with the present invention, there is also provided a centrifugal separator which comprises a basket; a scraper for scraping solid matter formed in the basket; an annular recess provided at the bottom of the basket to receive the scraped solid matter therein; and a solid matter discharge pipe having a solid matter intake inserted in the recess of the basket and serving to discharge the solid matter received in the recess to the exterior of the basket; the solid matter intake of the solid matter discharge pipe being formed to be open to the bottom surface of the recess; the rear end of the solid matter intake positioned at the rear based on the direction of rotation of the basket having a portion opposed to the bottom surface of the recess through a first gap defined therebetween to have a distance sufficient to allow the suction of the solid matter therethrough into the solid matter discharge pipe; the front end of the solid matter intake positioned at the front based on the direction of rotation of the basket having a portion opposed to the bottom surface of the recess through a second gap defined therebetween to have a distance larger than that of the first gap; the second gap being determined to have a size sufficient to communicate with a space formed in front of the front end of the solid matter intake and at the side of the solid matter discharge pipe due to the rotation of the basket with the interior of the solid matter discharge pipe.

Accordingly, it is an object of the present invention to provide a centrifugal separator which is capable of positively carrying out the downward movement of a scraper blade to effectively discharge solid matter.

It is another object of the present invention to provide a centrifugal separator which is capable of efficiently discharging solid matter formed in a basket to the exterior of the basket by suction using a conventional suction pump.

It is a further object of the present invention to provide a centrifugal separator which is capable of substantially decreasing the residue of solid material in a basket after the operation of discharging the solid matter.

It is still a further object of the present invention to provide a centrifugal separator which is capable of attaining the above-described objects with a significantly simpler structure.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Now, a centrifugal separator according to the present invention will be described hereinafter with reference to the accompanying drawings.

Figure 1:
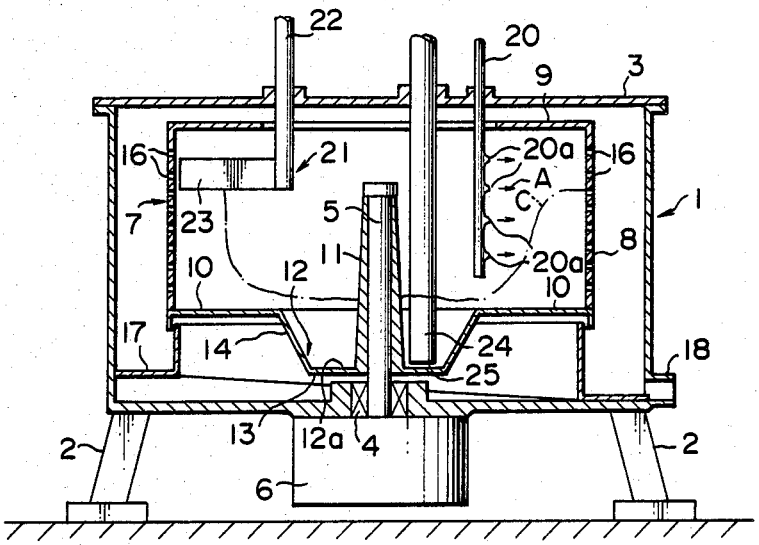
FIG. 1 is a schematic vertical sectional view showing one embodiment of a centrifugal separator according to the present invention.
Figure 2:
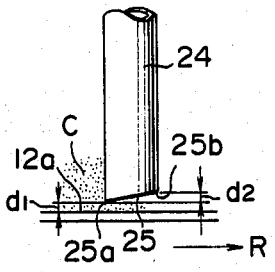
FIG. 2 is a partly side elevation view showing the configuration of a solid matter discharge pipe used in the centrifugal separator shown in FIG. 1, wherein the discharge pipe is viewed from the right side in FIG. 1.

FIGS. 1 and 2 schematically illustrate one embodiment of a centrifugal separator according to the present invention. A centrifugal separator of the illustrated embodiment includes a casing generally designated by reference numeral 1 which is supported on a support device 2 having a shock absorber. The casing 1 has a bottom and is formed into a cylindrical shape. The casing 1 is closed at the upper open end thereof with a lid 3 and provided at the central portion of the bottom thereof with a bearing 4 through which a vertical revolving shaft 5 is rotatably supported with respect to the casing 1. The revolving shaft 5 is connected at the lower end thereof to a revolving drive unit 6 such as a hydraulic motor mounted on the lower surface of the casing 1.

The centrifugal separator of the illustrated embodiment also includes a basket generally indicated by reference numeral 7, which comprises a peripheral wall 8 of a cylindrical shape, an annular upper end or top wall 9 provided to radially inward project from the upper end of the peripheral wall 8, a bottom wall 10 and a boss 11 provided at the central portion of the bottom wall 10. The boss 11 is supportedly fitted on the revolving shaft 5.

The bottom 10 of the basket 7 is formed at the central region thereof with an annular recess 12 in a manner to concentrically surround the boss 11. The recess 12 is formed into an inverted frustoconical shape in section by a bottom wall 13 and an oblique peripheral wall 14 obliquely upwardly extending from the outer peripheral edge of the bottom 13. The oblique peripheral wall 14 is contiguous at the upper end thereof to the inner peripheral edge of the horizontal bottom wall 10 of the basket 7. The peripheral wall 8 of the basket 7 is formed with a plurality of through-holes 16 which allow liquid component separated from stock liquid due to the rotation of the basket 7 to be outwardly diffused or discharged therethrough to carry out the drainage of the stock liquid.

To the lower portion of the inside of the peripheral wall of the casing 1 is attached an annular liquid guide member 17 of an L-shape in section by welding. Also, the casing 1 is provided at the lower end of the peripheral wall thereof with a liquid discharge port 18. The liquid guide member 17 has a bottom surface slanted to be lowermost at the position of the liquid discharge port 18, so that liquid component discharged from the basket 7 may be smoothly guided through the liquid guide member 17 to the liquid discharge port 18 to form solid matter or cake in the basket 7.

Reference numeral 20 designates a liquid supply pipe 20 which is inserted through the lid 3 of the casing 1 into the basket 7 so that stock liquid to be treated may be fed through a plurality of nozzles 20*a* provided at the supply pipe 20 into the basket 7 as indicated by an arrow A in FIG. 1.

The centrifugal separator also includes a scraper 21 which has a drive shaft 22 rotatably and slidably inserted through the lid 3 of the casing 1 into the basket 7. The drive shaft 22 has a scraper blade 23 mounted at the lower end thereof inserted into the basket 7. Also, the drive shaft 22 is connected to a driving unit (not shown), so that the scraper blade 23 may be rotated to approach the peripheral wall 8 of the basket 7 and moved downwardly toward the bottom of the basket 7.

The centrifugal separator of the illustrated embodiment further includes a solid matter discharge pipe 24 which is also inserted through the lid 3 into the basket 7 to position the lower end thereof in the recess 12. The solid matter discharge pipe 24 has a solid matter intake 25 provided at the lower end thereof, which is formed to be open to the bottom surface 12*a* of the recess 12. The solid matter discharge pipe 24 may be provided to constantly position the lower end thereof in the recess 12. Alternatively, the discharge pipe 24 may be slidably inserted through the lid 3, so that it may be moved upwardly when it hinders the smooth feeding of stock liquid through the liquid supply pipe 20 to the basket 7.

In the present invention, the solid matter intake is adapted to introduce gas in the basket 7 together with solid matter C in the recess 12 therethrough to the discharge pipe 24. In the embodiment shown in FIGS. 1 and 2, the solid matter intake 25 is constructed in a manner such that the rear end of the intake 25 facing the rearward side of the direction of rotation of the basket 7 or positioned at the rear based on the direction of rotation of the basket has a portion 25*a* opposed to the bottom surface 12*a* of the recess 12 through a first gap d1 defined therebetween to have a distance sufficient to allow powdered solid matter between the rear end of the intake 25 and the bottom surface 12*a* of the recess 12 to be sucked therethrough into the solid matter discharge pipe 24, and the front end of the intake 25 facing the forward side of the direction of rotation of the basket 7 or positioned at the front based on the direction of rotation of the basket has a portion 25*b* opposed to the bottom surface 12*a* of the recess 12 through a second gap d2 defined therebetween to have a distance larger than that of the first gap d1. The second gap d2 is determined to have a size sufficient to communicate with a space S (FIG. 3) formed in front of the front end of the solid matter intake 25 and at the side of the solid matter discharge pipe 24 due to the rotation of the basket with the interior of the solid matter discharge pipe 24.

In the illustrated embodiment, the solid matter intake 25 comprises a slanting opening formed by obliquely cutting the lower end of the solid matter discharge pipe 24 to slant the lower end face of the discharge pipe 24 with respect to the bottom surface of the recess 12, and the gap between the rear end of the opening and the bottom surface 12*a* of the recess 12 and that between the front end thereof and the bottom surface 12*a* are determined to be d1 and d2, respectively.

In the illustrated embodiment, the width or diameter of the bottom surface 12*a* of the recess 12 and the inner diameter of the solid matter discharge pipe 24 are determined depending upon the capacity of a suction pump used. More particularly. the width of the bottom surface 12*a* of the recess 12 and the inner diameter of the solid matter discharge pipe 24 are determined to allow each of the distance between the edge portion of the solid matter intake 25 and the the outer periphery of the bottom surface 12*a* of the recess 12 and the distance between the edge portion thereof and the inner periphery of the bottom surface 12*a* to be within a range capable of permitting the solid matter to be sucked into the discharge pipe 24.

Now, the manner of operation of the centrifugal separator of the illustrated embodiment described above will be described hereinafter with reference to FIGS. 1 to 4.

When the basket 7 is rotated at a high speed and stock liquid is fed through the liquid supply pipe 20 into the basket 7, liquid-removing or drainage is carried out through a filter (not shown) provided on the inner periphery of the basket 7 and the through-holes 16 to cause a layer of solid matter or cake to be formed on the inner periphery of the basket 7. Liquid component drawn off via the through-holes 16 of the basket 7 is guided through the liquid guide member 17 to the liquid discharge port 18 and outwardly discharged therefrom. Stock liquid which has entered the recess 12 is rapidly moved toward the peripheral wall 8 of the basket 7 along the slanting wall 14 by centrifugal force, so that any stock liquid may not remain in the recess 12.

Figure 3:
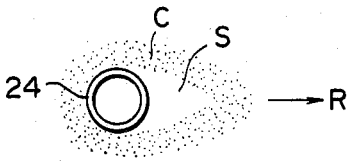
FIG. 3 is a schematic plan view showing a space formed ahead of the solid matter discharge pipe of FIG. 2.
Figure 4A:
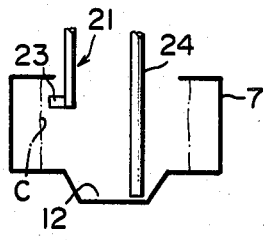
FIGS. 4A to 4C each are a schematic view showing the operation of the centrifugal separator shown in FIG. 1.
Figure 4B:
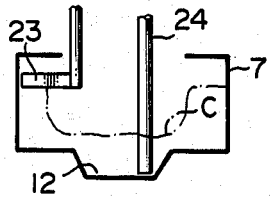

When a predetermined amount of solid matter C is formed as a layer in the basket 7 as shown in FIG. 4A, the basket 7 is decreased in rotational speed to continue the rotation at a low speed and then the scraper blade 23 is penetrated into the solid matter layer or cake C as shown in FIG. 4B. This causes the solid matter C to be scraped to drop into the recess 12 and deposited in the form of powders on the bottom thereof. The rotation of the basket 7 is to cause the solid matter in the recess 12 to flow in relation to the solid matter discharge pipe 24, however, the discharge pipe 24 hinders such flow of the solid matter, so that the space S at which no solid matter exists is constantly formed in front of the front end of the solid matter discharge pipe 24 or at the front of the pipe 24 based on the direction R of rotation of the basket 7, as shown in FIG. 3, or at the downstream side of pipe 24, considering the flow of powder C to the right in FIG. 2. The illustrated embodiment, as described above, is constructed in the manner that the front end of the solid matter intake 25 has the portion 25*b* opposed to the bottom surface 12*a* of the recess 12 with the gap d2 being defined therebetween which has a distance sufficient to communicate with the space S therethrough with the interior of the solid matter discharge pipe 24. Accordingly, when the solid matter or powder C in the recess 12 is sucked into the solid matter discharge pipe 24 connected to a suction pump (not shown), gas in the basket 7 including air and the like is concurrently sucked from the solid matter intake 25, to thereby form a gas stream in the discharge pipe which is sufficient to effectively prevent the solid matter discharge pipe from being closed or clogged. This allows the solid matter to be smoothly and rapidly transported through the discharge pipe 24 in a manner to be carried on the gas stream without using any specific or heavy-duty suction pump.

Figure 4C:
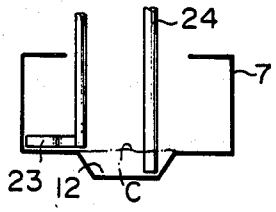

As can be seen from the foregoing, the illustrated embodiment effectively and continuously carries out the cake scraping and discharge operations without causing sufficient solid matter to hinder the downward movement of the scraper blade to be deposited below the blade, because the discharge of the solid matter by suction is smoothly carried out without interruption. When the discharge of the solid matter is advanced, the scraper blade 23 reaches the bottom of the basket 7 in time as shown in FIG. 4C. At that time, the scraper blade 23 is rotated about the drive shaft 22 toward the center of the basket 7 to drop all the solid matter remaining on the bottom of the basket into the recess 12. Since substantially all the solid matter dropped in the recess 12 is discharged through the discharge pipe 24, only a negligible amount of the solid matter remains in the basket 7.

After the solid matter is removed from the basket 7, wash liquid is fed to the basket to wash the interior of the basket, during which solid matter washed out by the wash liquid flows into the recess 12 together with the wash liquid and then is outwardly discharged through the discharge pipe 23.

The direction of rotation of the basket 7 during the liquid-removing treatment of stock liquid is not necessarily required to be the same as that during the discharge of solid matter. However, when the direction of rotation of the basket 7 during the liquid-removing operation is opposite to that R of rotation of the basket during the discharge of solid matter, mist of the liquid component generated in the basket is liable to enter the solid matter discharge pipe 24 through the front end of the solid matter intake 25. Accordingly, when it is required to prevent the entrance of the mist into the solid matter discharge pipe 24 as in the preparation of a pharmaceutical, the basket 7 is preferably rotated during the liquid-removing operation in the same direction as that of rotation of the basket during the solid matter discharge operation.

In the illustrated embodiment described above, the solid matter intake 25 comprises the opening provided at the distal or lower end of the solid matter discharge pipe 24 to have an end face slanted with respect to the bottom surface of the recess 12 of the basket 7. However, it should be noted that the solid matter intake 25 is not limited to such configuration so far as the gap d1 of a smaller distance sufficient to allow the solid matter to be sucked therethrough into the solid matter discharge pipe 24 is defined at the rear end of the solid matter intake 25 between the rear end of intake 25 and the bottom surface of the recess 12 and the gap d2 of a larger distance sufficient to communicate with the space S formed in front of the front end of the intake 25 due to the rotation of the basket 7 with the interior of the solid matter discharge pipe 24 is defined at the front end of the intake 25 between the front end and the bottom surface 12*a*.

Figure 5A:
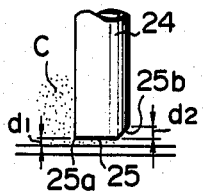
FIGS. 5A and 5B are schematic views showing modifications of a solid matter discharge pipe used in the present invention.
Figure 5B:
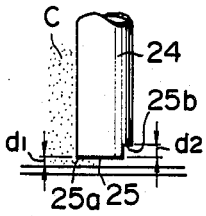

FIGS. 5A and 5B show modifications of the solid matter intake 25. A solid matter intake 25 shown in FIG. 5A comprises an opening provided at the distal or lower end of the solid matter discharge pipe 24 to have an end face parallel with the bottom surface 12*a* of the recess 12 and a front end obliquely cut to form a portion 25*b* having a second gap d2 between the front end portion and the bottom surface. The portion of the end face other than the portion 25*b* constitutes a portion 25*a* facing the bottom surface 12*a* of the recess 12 through a first gap d1.

A solid matter intake 24 shown in FIG. 5B comprises an opening provided at the lower end of the solid matter discharge pipe 24 which is cut at the front end thereof to form a step, to thereby provide a portion 25*b* facing the bottom surface 12*a* of the recess 12 through a second gap d2.

The above description has been made in connection with the centrifugal separator which is adapted to carry out the liquid-removing or drainage operation utilizing the through-holes 16 formed at the peripheral wall 8 of the basket 7. The present invention is not limited to a centrifugal separator of such type and contains a centrifugal separator called as a decanter which is adapted to carry out the drainage by removing liquid component by means of a skimming pipe.

Figure 6:
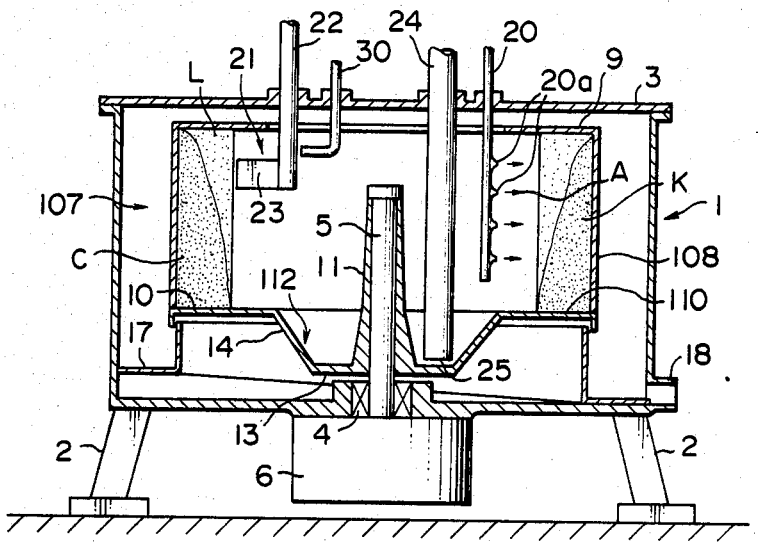
FIG. 6 is a schematic vertical sectional view showing another embodiment of a centrifugal separator according to the present invention.

FIG. 6 shows another embodiment of the present invention wherein the present invention is applied to a centrifugal separator adapted to carry out the drainage by means of a skimming pipe. In the illustrated embodiment, a basket 107 has a peripheral wall 108 which is not provided with through-holes and substitutedly has a skimming pipe 30 of an L-shape rotatably inserted through a lid 3 of a casing 1 into the basket 107. The basket 107 has a bottom wall 110 formed with an annular recess 112 and a solid matter discharge pipe 24 is provided at the lower end thereof inserted into the basket 107 with a solid matter intake 25, as in the embodiment described above. The remainder of the illustrated embodiment is constructed in substantially the same manner as the embodiment of FIGS. 1 and 2 described above.

The manner of operation of the centrifugal separator shown in FIG. 6 constructed as described above will be described hereinafter.

When stock liquid is fed into the basket 107 while rotating the basket at a high speed, a solid matter layer or cake C is formed on the inner surface of the peripheral wall 108 of the basket 107 and a liquid layer L is formed on the inside of the solid matter layer C, as shown in FIG. 6. After the separation between the solid matter layer C and the liquid layer L is completed, the skimming pipe 30 is moved to cause the distal end thereof to enter the liquid layer L to carry out the discharge of the liquid component through the skimming pipe 30. When the discharge of the liquid is completed, the solid matter C is scraped by means of a scraper 21 while rotating the basket at a low speed to be collected in the recess 112 and then outwardly discharged through the solid matter discharge pipe 24. In the illustrated embodiment, the solid matter intake formed at the lower end of the solid matter discharge pipe 24 is constructed in substantially same manner as that in the embodiment shown in FIGS. 1 and 2.

Figure 7:
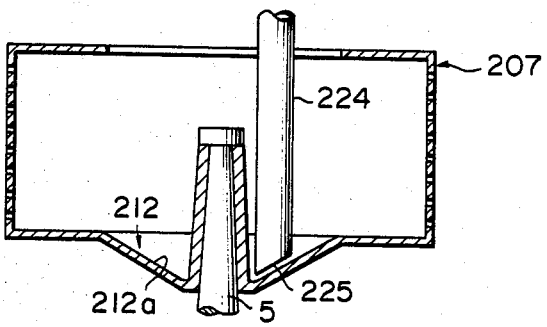
FIG. 7 is a vertical sectional view showing the essential part of a further embodiment of a centrifugal separator according to the present invention.

In each of the embodiments described above, the recess provided at the bottom of the basket has a flat bottom surface. However, the recess may be formed in a manner as shown in FIG. 7. More particularly, in FIG. 7, a basket 207 is provided at the bottom thereof with an annular recess 212 which has a slanting bottom surface 212*a* to be formed into substantially an inverted conical shape in section. In this instance, a solid matter discharge pipe 224 is preferably obliquely cut at the lower end thereof to form a solid matter intake 225 corresponding to the slope of the bottom surface of the recess 212. In the illustrated embodiment as well as the above-described ones, the solid matter intake 225 has a portion opposed to the bottom surface of the recess 212 at a gap d1 defined between the rear end thereof determined on the basis of the direction of rotation of the basket and the bottom surface of the recess 212 and a portion opposed thereto at a gap d2 defined between the front end thereof and the bottom surface, so that gas in the basket may be effectively sucked into the solid matter discharge pipe together with solid matter.

Figure 8:
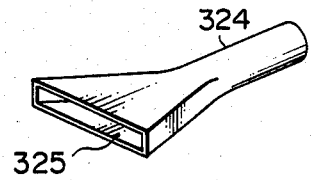
FIG. 8 is a perspective view showing another modification of a solid matter discharge pipe used in the present invention.

In each of the above-described embodiments, the solid matter discharge pipe comprises a straight pipe material and is open at the lower end thereof to the bottom surface of the recess to form the solid matter intake. However, the discharge pipe may be constructed as shown in FIG. 8. In FIG. 8, a solid matter discharge pipe 324 is provided at the lower end thereof with a flat enlarged portion which is open to the bottom surface of the recess to serve as a solid matter intake 325. Such construction allows the solid matter intake 325 to have a large width, so that the solid matter does not remain in the basket even when the bottom surface of the recess is significantly increased in width, to thereby discharge substantially all the solid matter.

The above described embodiments each are so constructed that the bearing for supporting the revolving shaft of the basket is provided at the lower portion of the casing. Alternatively, the bearing may be provided at the upper portion of the basket.

Figure 9:
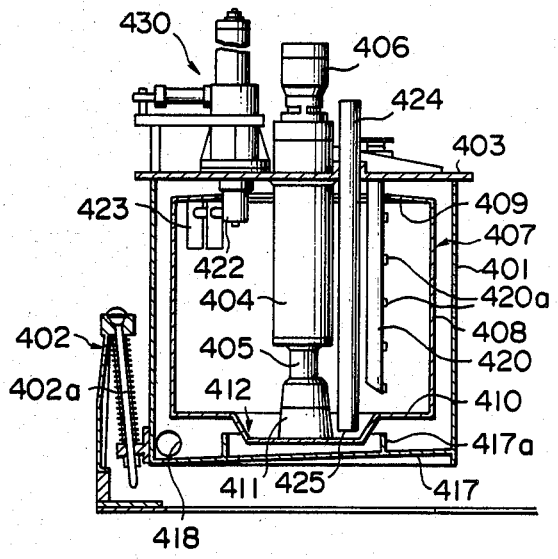
FIG. 9 is vertical sectional view showing still a further embodiment of a centrifugal separator according to the present invention.

FIG. 9 shows still a further embodiment of a centrifugal separator according to the present invention wherein a bearing for supporting a revolving shaft of a basket is arranged at the upper portion of the basket. In FIG. 9, reference numeral 401 designates a casing which has a bottom wall and is formed into a cylindrical shape. The casing 401 is supported by a support device 402 having a shock absorber 402*a* comprising a spring and closed at the upper opened end thereof with a lid 403. The centrifugal separator of the illustrated embodiment also includes a bearing 404 provided in a manner to be liquid-tightly inserted through the central portion of the lid 403, by which a revolving shaft 405 vertically extending is supported. The revolving shaft 405 is connected at the upper end thereof to a revolving drive unit 406 such as a hydraulic motor mounted on the upper end of the bearing 404. A basket generally indicated by reference numeral 407 comprises a cylindrical peripheral wall 408, an annular upper end wall 409 radially inward extending from the upper end of the peripheral wall 408, a bottom wall 410, and a boss 411 provided at the central portion of the bottom wall 410 and connected to the revolving shaft 405.

The basket 407 is formed at the bottom thereof with an annular recess 412 so as to surround the boss and at the peripheral wall 408 with a plurality of throughholes. The casing 403 is closed at the lower end thereof with a bottom plate 417, which has a liquid guide plate 417*a* welded to the inner surface thereof. Also, the side wall of the casing 401 is formed at the lower portion thereof with a liquid discharge hole 418, and correspondingly the the bottom plate 417 is slanted to be lowermost at the position of the hole 418.

The centrifugal separator of the illustrated embodiment also includes a liquid supply pipe 420 which is inserted through the lid 403 into the basket 407 and has a plurality of nozzles 420*a* provided in the longitudinal direction thereof, a scraper having a drive shaft 422 on which scraper blades are mounted, and a drive device 430 mounted on the lid 403 for driving the scraper which comprises a drive mechanism for vertically moving the drive shaft 422 and a rotation mechanism for rotating the drive shaft 422. Reference numeral 424 designates a solid matter discharge pipe which is inserted through the lid 403 into the basket and formed at the lower end thereof with a solid matter intake 425 positioned in the recess 412.

Figure 10:
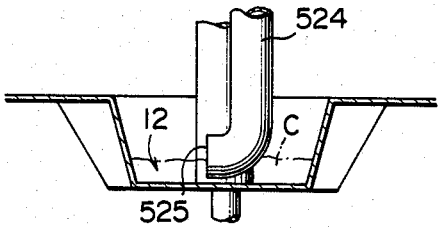
FIGS. 10 to 13 are schematic views showing further modifications of a solid matter discharge pipe used in the present invention.
Figure 11:
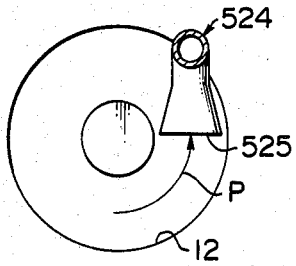
Figure 12:
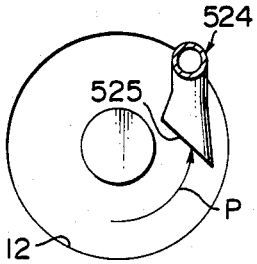
Figure 13:
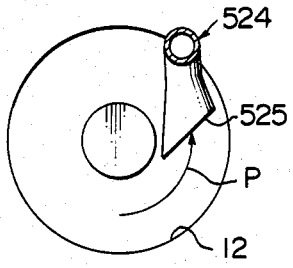

In each of the embodiments described above, the solid matter intake of the solid matter discharge pipe is open to the bottom surface of the recess, however, the manner of opening of the solid matter intake with respect to the recess is not limited to the above description. For example, the solid matter discharge pipe in the embodiment shown in FIG. 1 may be modified as shown in FIG. 10. In FIG. 10, a solid matter discharge pipe 524 is bent or curved at the lower end thereof to horizontally or obliquely downward direct a solid matter intake 525. In this instance, the solid matter intake 525 may be so positioned that the open end face thereof is directed in parallel with the radial direction of the recess 12 as shown in FIG. 11. Alternatively, the open end face of the intake 525 may be directed to be oblique with respect to the radial direction of the recess as shown in FIG. 12 or 13.

In the modifications shown in FIGS. 10 to 13, the basket may be rotated in any direction during the discharge of the solid matter. However, when the basket is rotated in the direction of allowing the solid matter intake 525 to be rearward directed on the basis of the direction of rotation of the basket as indicated by an arrow P in FIGS. 11 to 13, the solid matter may be positively forced in the intake 525, to thereby facilitate the introduction of solid matter into the solid matter discharge pipe. However, such construction is liable to cause the solid matter discharge pipe to be clogged with the solid matter when the solid matter is received in large amounts in the recess 12; thus, it is preferable to suitably adjust the scraping of the solid matter.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A centrifugal separator comprising:

a basket;

b a scraper for scraping solid matter formed in said basket;

an annular recess provided at the bottom of said basket to receive said scraped solid matter therein; and a solid matter discharge pipe having a solid matter intake inserted in said recess of said basket and serving to discharge the solid matter received in said recess therethrough to the exterior of said basket.

2. A centrifugal separator as defined in claim 1, wherein said solid matter intake of said solid matter discharge pipe is open to the bottom surface of said recess.

3. A centrifugal separator as defined in claim 2, wherein the rear end of said solid matter intake positioned at the rear based on the direction of rotation of said basket has a portion opposed to the bottom surface of said recess through a first gap defined therebetween to have a distance sufficient to permit the suction of the solid matter therethrough into said solid matter discharge pipe; and the front end of said solid matter intake positioned at the front based on the direction of rotation of said basket has a portion opposed to the bottom surface of said recess through a second gap defined therebetween to have a distance larger than that of said first gap;

said second gap being formed to have a size sufficient to communicate with a space formed in front of said front end of said solid matter intake and at the side of said solid matter discharge pipe due to the rotation of said solid matter discharge pipe with the interior of said solid matter discharge pipe.

4. A centrifugal separator as defined in claim 1, wherein said solid matter intake of said solid matter discharge pipe is open to the direction opposite to the direction of rotation of said basket.

5. A centrifugal separator as defined in claim 1, wherein said solid matter intake of said solid matter discharge pipe is open to the direction of rotation of said basket.

6. A centrifugal separator as defined in claim 1, wherein said recess has a horizontal bottom and an outer periphery of which the diameter is gradually increased in the upward direction.

7. A centrifugal separator as defined in claim 6, wherein said bottom surface of said recess has a width determined to set each of the distance between said solid matter intake and the outer periphery of the bottom surface of said recess and the distance between said solid matter intake and the inner periphery of the bottom surface of said recess within a range capable of allowing the suction of the solid matter through said solid matter intake into said solid matter discharge pipe.

8. A centrifugal separator as defined in claim 1, wherein said recess has a bottom which extends to the bottom of said basket while keeping a slanting state.

9. A centrifugal separator as defined in claim 8, wherein said solid matter intake is positioned at a part thereof in proximity to the lowermost portion of said slanting bottom of said recess.

10. A centrifugal separator as defined in claim 1, wherein said basket is formed at the peripheral wall thereof with a plurality of through-holes through which the liquid-removing operation is carried out.

11. A centrifugal separator as defined in claim 1. wherein said basket has a peripheral wall which is formed with no through-holes and a skimming pipe which is inserted at the distal end thereof in a liquid layer formed in said basket;

the liquid-removing being carried out by discharging liquid through said skimming pipe.

12. A centrifugal separator as defined in claim 1, wherein said basket is supported at the lower portion thereof on a revolving shaft.

13. A centrifugal separator as defined in claim 1, wherein said basket is supported at the upper portion thereof on a revolving shaft.

14. A centrifugal separator as defined in claim 13, wherein said basket is formed at the peripheral wall thereof with a plurality of through-holes through which the liquid-removing operation is carried out.

15. A centrifugal separator as defined in claim 13, wherein said basket has a peripheral wall which is formed with no through-holes and a skimming pipe which is inserted at the distal end thereof in a liquid layer formed in said basket;

the liquid-removing being carried out by discharging liquid through said skimming pipe.

16. A centrifugal separator as defined in claim 13, wherein said basket is supported at the lower portion thereof on a revolving shaft.

17. A centrifugal separator as defined in claim 13, wherein said basket is supported at the upper portion thereof on a revolving shaft.

18. A centrifugal separator comprising:

a rotatable basket;

a scraper for scraping solid matter formed in said basket;

an annular recess provided at the bottom of said basket to receive said scraped solid matter therein; and a solid matter discharge pipe having a solid matter intake inserted in said recess of said basket and serving to discharge the solid matter received in said recess therethrough to the exterior of said basket;

said solid matter intake of said solid matter discharge pipe being formed to be open to the bottom surface of said recess;

the rear end of said solid matter intake positioned at the rear based on the direction of rotation of said basket having a portion opposed to the bottom surface of said recess through a first gap defined therebetween to have a distance sufficient to allow the suction of the solid matter therethrough into said solid matter discharge pipe;

the front end of said solid matter intake positioned at the front based on the direction of rotation of said basket having a portion opposed to the bottom surface of said recess through a second gap defined therebetween to have a distance larger than that of said first gap;

said second gap being determined to have a size sufficient to communicate with a space formed in front of said front end of said solid matter intake and at the side of said solid matter discharge pipe due to the rotation of said basket with the interior of said solid matter discharge pipe.

* * * * *